United States Patent [19]

Vertegaal

[11] 3,994,220

[45] Nov. 30, 1976

[54] PRESSURIZED SQUEEGEE WITH STIFF RESILIENT SEALING STRIPS

[75] Inventor: Jacobus Gerardus Vertegaal, Boxmeer, Netherlands

[73] Assignee: Stork Amsterdam B.V., Amstelveen, Netherlands

[22] Filed: July 1, 1975

[21] Appl. No.: 592,355

Related U.S. Application Data

[63] Continuation of Ser. No. 443,317, Feb. 19, 1974, abandoned.

[30] Foreign Application Priority Data

Feb. 26, 1973 Netherlands ..... 7302664

[52] U.S. Cl. ..... 101/119; 101/120

[51] Int. Cl.[2] ..... B41F 15/40; B41F 15/44

[58] Field of Search ..... 101/114, 115, 116, 119, 101/120, 123, 124

[56] References Cited

UNITED STATES PATENTS

| | | | |
|---|---|---|---|
| 1,541,787 | 6/1925 | Cadgene et al. | 101/120 |
| 2,581,775 | 1/1952 | Wade | 101/120 X |
| 3,613,635 | 10/1971 | Brehm | 101/119 X |
| 3,631,800 | 1/1972 | Mignone et al. | 101/350 |
| 3,680,968 | 8/1972 | Schwartzman et al. | 401/260 |
| 3,890,896 | 6/1975 | Zimmer | 101/119 |
| 3,921,520 | 11/1975 | Zimmer | 101/120 |

FOREIGN PATENTS OR APPLICATIONS

| | | | |
|---|---|---|---|
| 186,221 | 10/1955 | Austria | 101/120 |

*Primary Examiner*—Edgar S. Burr
*Assistant Examiner*—R. E. Suter
*Attorney, Agent, or Firm*—Edmund M. Jaskiewicz

[57] ABSTRACT

A paint feeding element to be used in a cylindrical screen stencil machine, said element being composed of an oblong reservoir connected to a paint supply and two converging rigidly-resilient thin strips forming a mouth piece for contact with the inner wall of a stencil, both strips enclosing a steep angle with said wall.

11 Claims, 15 Drawing Figures

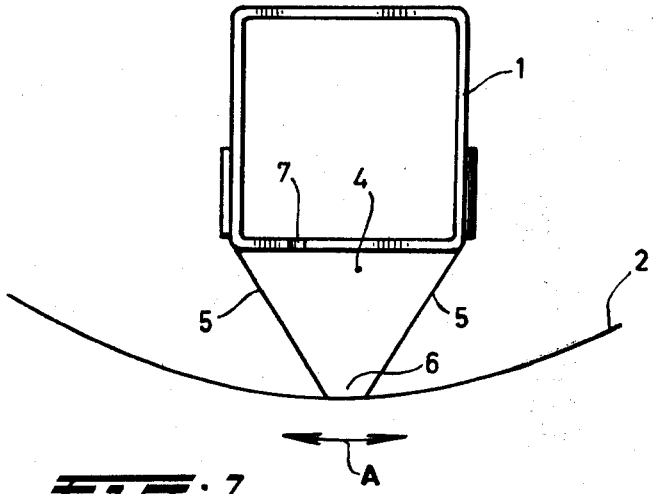
FIG: 1.
FIG: 2.
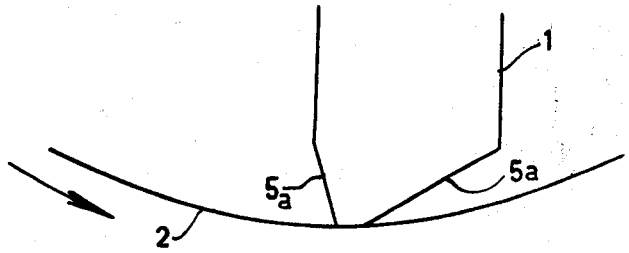

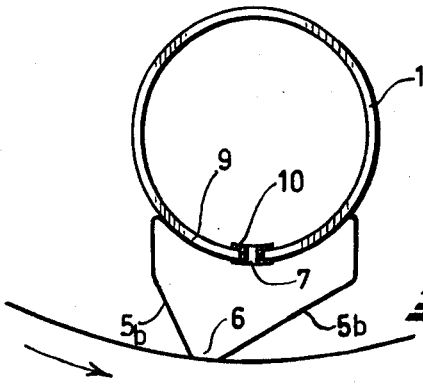
Fig: 6.
Fig: 7.
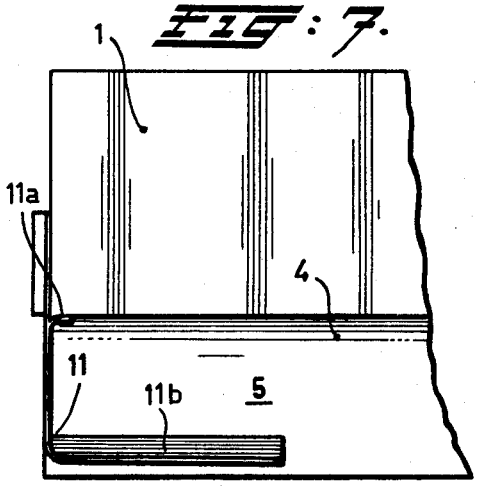
Fig: 8.
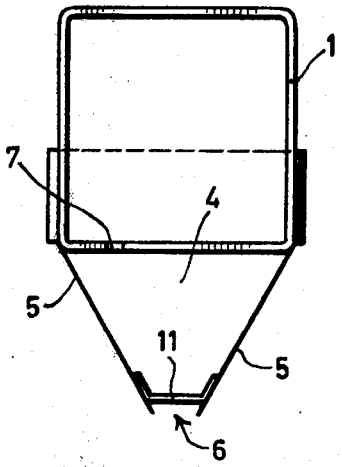
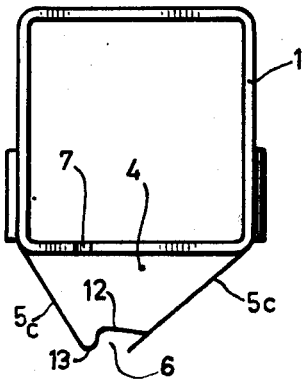
Fig: 9.
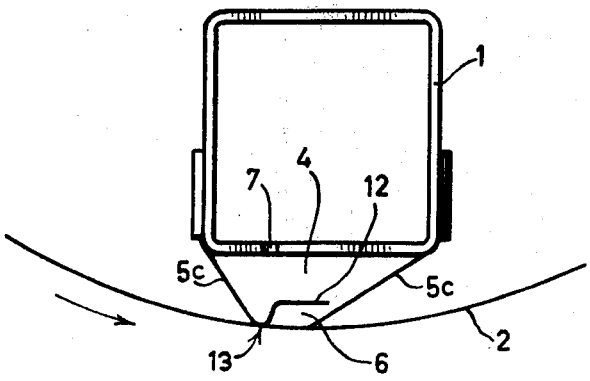
Fig: 10.

PRESSURIZED SQUEEGEE WITH STIFF RESILIENT SEALING STRIPS

This is a continuation of application Ser. No. 443,317, filed Feb. 19, 1974, now abandoned.

DISCUSSION OF THE PRIOR ART

My invention relates to a paint feeding element to be used in a screen printing machine which is provided with at least one cylindrical stencil, the element consisting of an oblong reservoir connected to a feed pipe for the paint and with a narrow slit-shaped mouth piece which can come into sealing contact with an area along the inside of the associated stencil.

Such an element can be substituted for a conventional squeegee by means of which the desired quantity of paint is pressed through the perforations of the stencil. When the length of the stencil increases, as is the case when wide webs are being printed, the problem occurs of a uniform distribution of the paint or printing paste on the full width of the web(s). This problem has already been solved partially by the paint feeding element as described in the preamble of this specification.

SUMMARY OF THE INVENTION

My invention aims to improve this element known in the art to such an extent that a certain flexibility of the metering slit is provided in order to regulate the paint application. This is attained by the arrangement that the longitudinal sides of the slit-shaped mouth piece are composed of two relatively stiff but resilient thin strips disposed on either side of the reservoir, converging with respect to each other by their free ends and constituting the delimiting lips of a metering slit which is adjustable in width.

These flexible lips mainly have a threefold function, since they serve for sealing the paint enclosed in the mouth piece, for continuously cleansing the inside of the stencil by scraping and for adjusting the width of the slit. The latter becomes possible by pressing the paint feeding element more or less against the inner wall of the stencil. The supporting reaction force is hereby obtained in the usual manner by means of a printing table, roller or similar member over which the material to be printed advances.

Various modifications of the general embodiment as described hereinbefore are conceivable like for example a paint feeding element, the strips of which are a-symmetrically arranged. The strip ends may be bent inwards or outwards and have a flowing shape, or are angularly arranged.

An extensive range of embodiments is conceivable with a provision for closing the mouth piece of the paint feeding element, when the latter does not operate. This provision may consist of a bent edge of one of the strips, which edge can contact the inside of the other strip. The provision may, however, also be constructed either as a closing member consisting of a V-shaped strip or a cylindrical rod situated within the mouth piece.

One of the advantages of the paint feeding element as described above consists in a positive regulation of the pressure in the paint within the mouth piece. In this way a better printing or penetration is obtained. The pressure in the paint can be generated by the feed pump itself, but this offers a rather coarse regulating possibility. According to the invention a finer regulation can be achieved when the reservoir at its end turned away from the mouth piece, is delimited by a membrane over which a pneumatic pressure chamber is arranged and when beside the reservoir an auxiliary space is provided to which a paint feeding pump is connected, while the space is connected via at least one opening with the reservoir and furthermore means are provided to control the output of the pump in dependence of the paint consumption.

SURVEY OF THE DRAWINGS

FIG. 1 shows a first embodiment of a paint feeding element with a symmetrical arrangement;

FIG. 2 shows an asymmetrical paint feeding element;

FIG. 6 shows a modification of the element according to FIG. 2;

FIGS. 7 and 8 are a longitudinal section and a cross-section of a lateral closure for the paint feeding element;

FIGS. 9 to 14 show three modifications in which a provision is available for closing the mouth piece;

DESCRIPTION OF PREFERRED EMBODIMENTS

Figure 3:
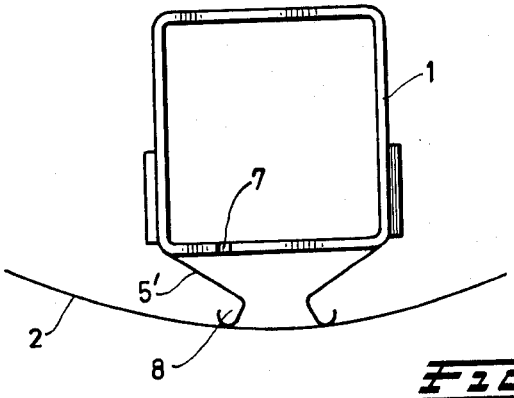
FIGS. 3–5 show three modifications of the element according to FIG. 1.

As is visible in FIG. 1 the paint feeding member consists of a reservoir 1 the length of which substantially corresponding to the length of the associated stencil 2. At one end this reservoir 1 is provided with a connection 3 (see FIG. 15) for a paint feeding pipe. On its underside the reservoir has a mouth piece 4 with a narrow slit which can come into sealing contact with an area A along the inner surface of the stencil 2.

The long sides of the slitted mouth piece 4 are constructed of two relatively stiff but resilient thin strips 5 disposed on either side of the reservoir 1, which converge with respect to each other by their free ends. These strips 5 constitute delimiting lips of a metering slit 6 which is adjustable in width. The strips 5 are preferably made of an elastically flexible material, like a high grade steel or a plastic.

The arrangement according to FIG. 1 is symmetrical, so that the strips 5 constitute with the underside of the reservoir an isosceles triangle with an apex smaller than 60°. The tangent angle of the leading strip 5 — as seen in the direction of rotation — is with the inside of the stencil 2 at least 60° in order to avoid a possible squeegee effect. The connection between the reservoir 1 and the mouth piece 4 consists of one or more openings 7 which are staggered with respect to the metering slit 6.

The modification according to FIG. 2 is distinguished in that the strips **5*a* are asymmetrically arranged with respect to a main symmetry plane extending in the longitudinal direction of the reservoir 1, so that the tangent angle of the two strips with the inside of the stencil 2** differs.

Figure 4:
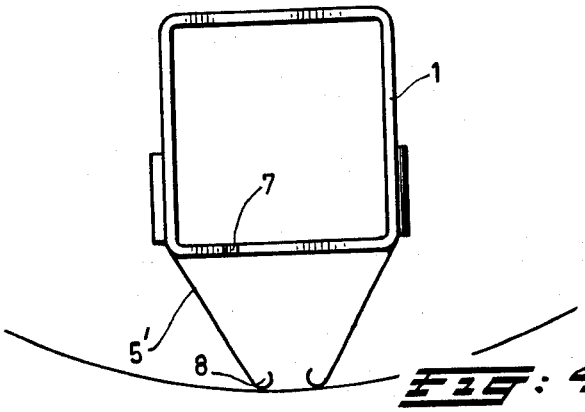
Figure 5:
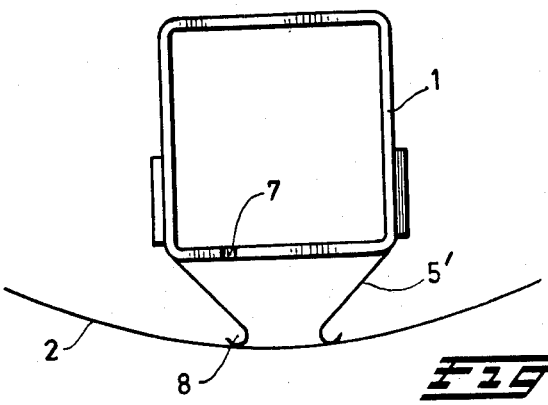

The embodiments according to FIGS. 3–5 correspond almost entirely to the modification as in FIG. 1. The only difference is that the ends 8 of the strips 5' are bent. This is advisable under particular circumstances such as when a rather considerable angle is enclosed between the strip 5' and the stencil 2.

The embodiment as in FIG. 6 is provided with a cylindrical reservoir 1', while the two strips **5*b* consist of the ends of a single very wide strip the central part 9** of which is bent to conform to the outer shape of the reservoir 1 and connected thereto by some fixing means 10.

The narrow ends (the end faces) of the paint feeding element are not closed by the strip 5. In order to avoid an undesired outflow of the paint at these locations each end of the mouth piece 4 is closed by means of a bent resilient tongue 11 of substantially L-section as seen in FIG. 7 which has one end 11*a* mounted to the reservoir 1 and has its other end 11*b* bearing on the inside of the strips 5. This is depicted in FIGS. 7 and 8.

The modification as shown in FIGS. 9 and 10 provides for closing the mouth piece 4, when the paint feeding element does not operate. Such structure is situated above the metering slit 6 and consists of a bent edge 12 of one of the strips 5*c*. The inoperative position is depicted in FIG. 9. In the inoperative position there is no contact between the mouth piece 4 and the stencil 2. Due to the resilience of the relating strip 5*c*, the border or edge 12 (when there is no contact with the stencil 2) contacts the inside of the other strip 5*c* and closes the mouth piece 4, consequently.

In FIG. 10 the operative position of the paint feeding element is shown. In this case an edge 13 of the left-hand strip 5*c* is in touch with the stencil 2, whereby the bent edge 12 is pushed back and a connection is established between the metering slit 6 and the interior of the mouth piece 4.

Figure 11:
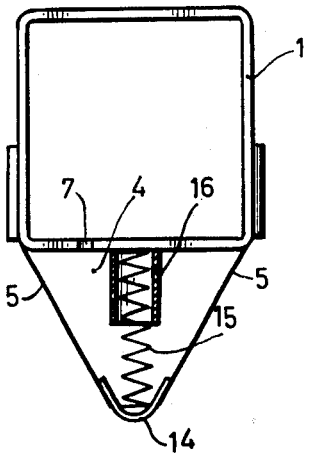
Figure 12:
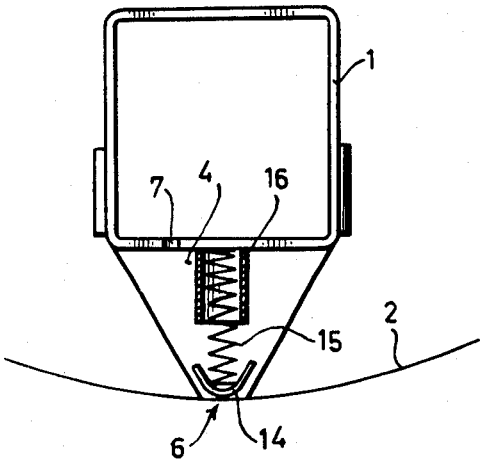

In the modification according to FIG. 11 and FIG. 12 the provision consists of a V-shaped tape or elongated member 14 situated within the mouth piece 4. This member is pressed, by means of a spring 15 mounted in a cylinder 16, towards the metering slit 6. In the inoperative position of the paint feeding element (see FIG. 11) the member 14 bears on the strips 5 and the mouth piece 4 is closed. In operative position (see FIG. 12) the stencil 2 presses the member 14 slightly upwards whereby a connection between the metering slit 6 and the mouth piece 4 is established.

Figure 13:
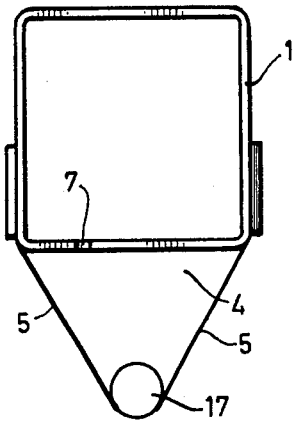
Figure 14:
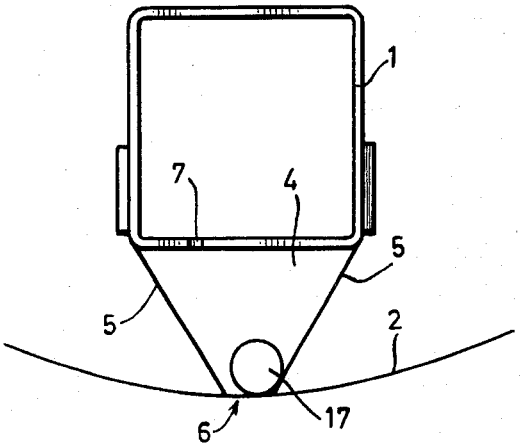

In the embodiment as shown in FIGS. 13 and 14 the provision consists of a cylindrical rod 17 situated within the mouth piece 4. This rod has a diameter, larger than the width of the metering slit 6 of the paint feeding element so as to close the mouthpiece when the same is in its inoperative position (see FIG. 13).

Figure 15:
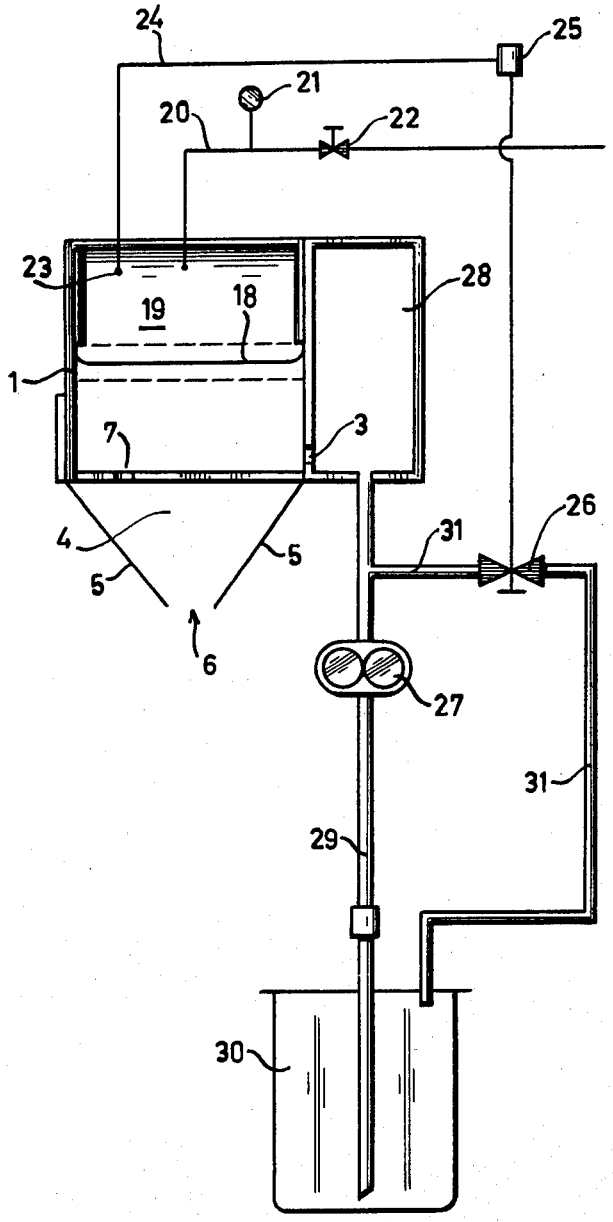
FIG. 15 represents diagrammatically a system for regulating the pressure of the paint in the mouth piece.

FIG. 15 shows an embodiment for regulating the pressure in the paint paste within the mouth piece 4. This possibility of pressure regulation is one of the advantages of the paint feeding element as hereinbefore described. The reservoir 1 is closed on its upper side by a membrane 18, so that a pneumatic pressure chamber 19 can be formed above it. This chamber is connected with a source of compressed gas (not shown) via a pipe 20 with pressure gauge 21 and shut off valve 22.

Chamber 19 is also provided with a pressure sensor 23 which, via a line 24, can emit a signal to a regulator 25 for a valve 26. The paint for the mouth piece 4 is supplied via a pump 27 to an auxiliary space 28 which communicates with the mouth piece 4, via the openings 3 and 7. The pump 27 sucks, via a pipe 29, paint from a supply container 30. There is furthermore a bypass 31 with the valve 26.

The operation is as follows:

The sensor 23 is adjusted at a pressure, required for obtaining the paint penetration aimed at into the material to be printed. The pump 27 has a constant output, part of which escapes via pipe 31 and valve 26. When the paint consumption increases, for instance owing to an increased velocity of the material to be printed, the quantity of paint in the mouth piece 4 will decrease and the membrane 18 will go down.

Consequently the pressure in chamber 19 decreases. The sensor emits a signal to the regulator 25 such that the valve 26 is slightly moved towards the closed position. Hence, more paint flows to the auxiliary space 28 and to the mouth piece 4. The regulation is continued until the pressure in the chamber 19 has regained its original value. The position of valve 26 is then adapted to the new situation.

When the paint consumption decreases then a converse situation occurs and the valve 26 is moved to a further opened position.

What I claim is:

1. Paint feeding element to be used in a screen printing machine which is provided with at least one cylindrical stencil, the element comprising an oblong reservoir connected to a feed pipe for the paint and with a narrow metering slit mouth piece connected with said reservoir and having a sealing contact with an area along the inner wall of the associated stencil to define a closed system having no open communication to the atmosphere from the paint feeding element, said mouth piece comprising two stiff but resilient thin metal strips of a high grade steel connected on either side of the reservoir and having free ends converging with respect to each other to constitute the delimiting lips of said metering slit, the angle between the leading strip - as seen in the direction of rotation of the cylindrical stencil - and the inner wall of the stencil is at least 60°, said reservoir comprising a pressurized chamber into which said paint is introduced, and means comprising a sensor connected to a valve means for regulating the flow of said paint from said feed pipe to said reservoir.

2. Paint feeding element as in claim 1, in which the strips are asymmetrical with respect to a main symmetry plane extending in the longitudinal direction of the reservoir, so that the tangent angle of one of the two strips with the inner wall of the stencil is different from that of the other strip.

3. Paint feeding element, according to claim 1 in which the ends of the strips in separate contact with the inner wall of the stencil, are bent, the unbent portion of the leading strip as seen in the direction of rotation of the stencil forming said 60° angle.

4. Paint feeding element according to claim 1 wherein the reservoir comprises a hollow beam with openings therein, communicating with the mouth piece, said openings being staggered with respect to the metering slit.

5. Paint feeding element according to claim 1 in which the end faces of the mouth piece has ends closed by the provision of a resilient tongue of substantially L-section, which has one end mounted to the reservoir and its other end bears on the inside of the strips.

6. Paint feeding element as claimed in claim 1, in which the reservoir on its side away from the mouth piece, is delimited by a membrane, a pneumatic pressure chamber being situated above the latter, means in said pneumatic pressure chamber for indicating the pressure therein, an auxiliary space being provided adjacent the reservoir to which space a paint feeding pump is connected, said space being connected via at least one opening, with the reservoir and means being provided controlling the output of the pump in dependence of the paint consumption of the paint feeding element.

7. Paint feeding element according to claim 1 and means within the mouth piece and above the metering slit for closing the metering slit when the paint feeding element is in its inoperative position.

8. Paint feeding element as in claim 7 wherein said closing means comprises a free end of one of the strips bent so as to be engageable with the inside of the other strip.

9. Paint feeding element as in claim 7 in which the closing means comprises an elongated member of substantially V-section within the mouth piece, which by means of a spring is pressed towards the metering slit into engagement with said strips.

10. Paint feeding element as in claim 9, in which the closing member comprises an elongated member of substantially V-section within the mouth piece, which by means of a spring is pressed towards the metering slit into engagement with said strips.

11. Paint feeding element as in claim 9, wherein the closing member comprises a cylindrical rod within the mouth piece and having a diameter larger than the width of the metering slit when the paint feeding element is in its inoperative position.

* * * * *